United States Patent [19]

Lyman

[11] Patent Number: 4,553,770

[45] Date of Patent: Nov. 19, 1985

[54] WHEELCHAIR ATTACHMENT

[76] Inventor: Roger T. Lyman, 2810 Marlin Ct., Punta Gorda, Fla. 33950

[21] Appl. No.: 511,382

[22] Filed: Jul. 6, 1983

[51] Int. Cl.[4] ..... A61G 5/00

[52] U.S. Cl. ..... 280/289 WC; 297/DIG. 4

[58] Field of Search ..... 280/289 WC, 242 WC, 280/650, 647, 42; 297/45, DIG. 4

[56] References Cited

U.S. PATENT DOCUMENTS

| | | | |
|---|---|---|---|
| 2,669,289 | 2/1954 | Usher et al. | 297/45 X |
| 2,818,910 | 1/1958 | Hawkins | 297/45 |
| 4,082,348 | 4/1978 | Haury | 297/45 |
| 4,264,085 | 4/1981 | Volin | 280/289 WC |

*Primary Examiner*—John A. Pekar

*Attorney, Agent, or Firm*—Hauke and Patalidis

[57] ABSTRACT

A wheelchair attachment for maintaining the wheelchair in a reduced width position includes an elongate member extending between side frames of the wheelchair and the end portions of the elongate member are looped around the side frames. Both ends are releasably secured in such a manner that the elongate member may be quickly and easily attached to the wheelchair in the reduced width position, and detached from the wheelchair to permit it to expand to its normal width.

8 Claims, 6 Drawing Figures

WHEELCHAIR ATTACHMENT

BACKGROUND OF THE INVENTION

The present invention relates generally to wheelchairs and to improvements therein. People who are required to use a wheelchair often find it very difficult and sometimes impossible to maneuver the wheelchair and themselves through narrow doorways, like those installed on bathrooms and some other rooms of buildings. Most of these doorways are only about twenty-three and one-half inches wide and the full, extended width of a conventional wheelchair is twenty-six inches wide.

It is obvious, then, that some means such as an attachment to the wheelchair is necessary to shrink laterally the width of the wheelchair so that it and the occupant can pass through such narrow doors. Such a wheelchair attachment should be readily available and, preferably, carried on the wheelchair in a convenient location. It should be readily and easily attachable and in some instances, may be kept attached to the wheelchair at all times.

Devices for reducing or shrinking the lateral width of a wheelchair are known from the prior art and from U.S. Pat. Nos.: 3,937,490; 4,264,085; and 4,375,295.

SUMMARY OF THE INVENTION

An elongate member is disposed between the side frames of a wheelchair when it is in the partially folded and reduced lateral width position. The end portions of such member are looped around the side frames of the wheelchair, and means is provided for attaching and releasing the looped end portions to keep the wheelchair at a desired reduced lateral width.

For a further understanding of the invention and for the features and advantages thereof, reference may be made to the following description and to the drawing which illustrates two embodiments of the invention.

DETAILED DESCRIPTION

Figure 1:
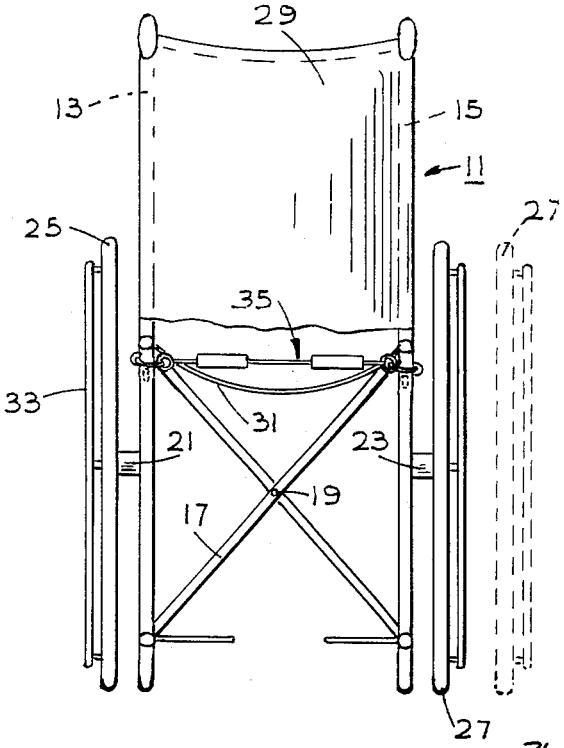
FIG. 1 is a schematic rear elevational view of a conventional wheelchair to which one embodiment of the invention is attached.

Referring to FIG. 1, a conventional wheelchair 11 is shown as one would observe it from the rear. It comprises tubular side frame members 13, 15 a cross bracing 17 that is pivoted at 19, axles 21,23 attached to the side frame members 13,15, and main wheels 25,27 that are journaled to the axles 21,23. A fabric back 29 is attached to the side frame members 13,15 as is a fabric seat 31. The main wheels 25,27 are each provided with a conventional hand-grip wheel 33 for propulsion of the wheelchair by the occupant thereof.

The construction of the wheelchair described so far is that of the most common type of folding wheelchair, and a more detailed description thereof is unnecessary for a proper understanding of the present invetion.

Figure 2:
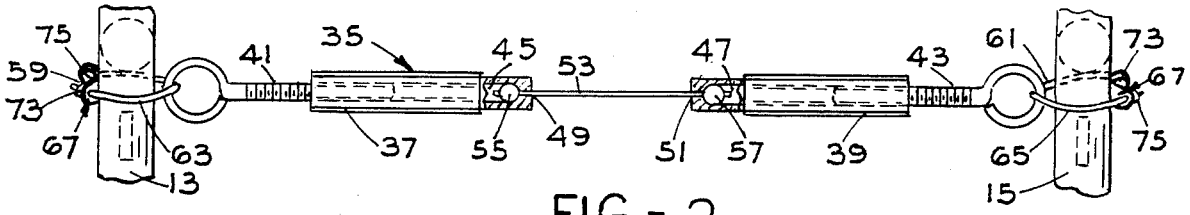
FIG. 2 is a view of such one embodiment of the invention.

A device 35 for holding the wheelchair at the reduced lateral width, as best shown at FIG. 2, comprises a pair of opposed hollow turnbuckle-like elements 37,39, and each one of these turnbuckle-like elements is open ended at one end and partially threaded internally therealong for receiving the threaded end portion of eyebolts 41,43. The other end of the turnbuckle-like elements 37,39 is partially closed, forming therein a cavity 45,47 with an aperture in the partially closed end, such aperture being designated 49,51. In the cavities 45,47 of the end portions of the turnbuckle-like elements 37,39, there are stop members, in the form of balls 55,57 that are fixed to the ends of a flexible cable 53 that passes through the apertures 49,51.

Figure 3:
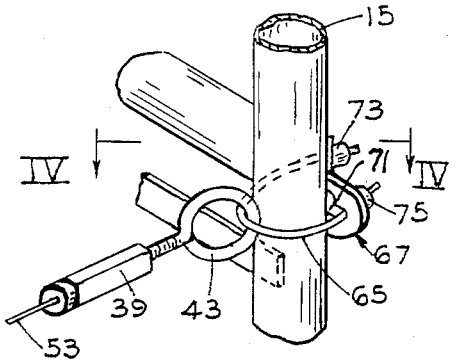
FIG. 3 is a schematic view, in perspective, of one end portion of the structure of FIG. 2.
Figure 4:
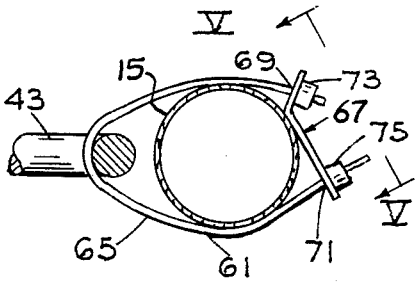
FIG. 4 is a view along line IV—IV of FIG. 3.
Figure 5:
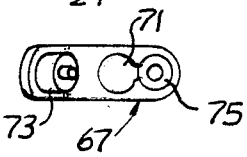
FIG. 5 is a view along line V—V of FIG. 4.

Associated with each eyebolt 41,43, as viewed in FIGS. 3, 4, are quick attaching and detaching devices 59,61. Each such device 59,61 comprises a length of flexible cable, or the like, 63,65 and a bent plate member 67 having a hole 69 in one end portion and having a keyhole-shaped aperture 71 in the other end portion. One end of the flexible cable 63,65 passes through the hole 69 and is fitted with a stop member 73 to prevent the flexible cable from being withdrawn through the hole 69. The other end of the flexible cable 63,65 is fitted with a stop member 75 that is sized to pass through the larger portion of the keyhole-shaped aperture 71, but cannot pass through the slot portion of the keyhole aperture 71.

Figure 6:
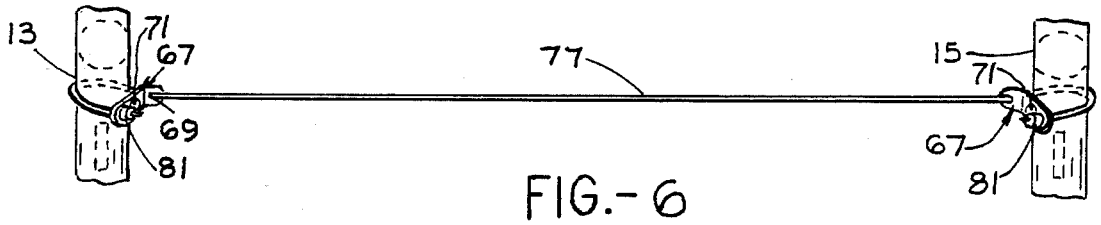
FIG. 6 is a schematic view similar to that of FIG. 2, but showing the other embodiment of the invention.

FIG. 6 shows another embodiment of the invention and comprises a length of flexible cable 77, or the like, that passes through the hole 69 in the one end portion of the bent plate 67 and is looped around the side frame members 13, 15. The ends of the flexible cable 77 are fitted with stop members 79,81 that pass freely through the larger hole portion of the keyhole aperture 71, but cannot pass through the narrow slot of the keyhole aperture 71. The length of the flexible cable 77 is such that when it is installed as shown in FIG. 6, the width of the wheelchair is the reduced width that allows it and the occupant to pass through the narrow doorways.

In using the device 35 of FIG. 2, one end of the flexible cable 63 passes through the eye of the eyebolt and is looped around the side frame member, say member 13, and through the keyhole-shaped aperture 71 in the bent plate 67. The other flexible cable 65 passes through the other eyebolt and around the side frame member 15 and through the keyhole-shaped aperture 71. In order to install the device 35 as described, the wheelchair 11 will have been folded to a narrow reduced width. If necessary, the turnbuckle-like members 37,39 may be turned on the threaded ends of the eyebolts 41,43 to adjust the width of the wheelchair in the reduced width position. Also, if desired, locknuts may be threaded onto the eyebolts 41,43 to engage the turnbuckle-like members 37,39 to secure them in a selected position.

The device of FIG. 6 is used in a similar manner. The flexible cable is looped around the side frame members **13*a*, 15*a* when the wheelchair is folded to a reduced width position. The stop members on the ends of the flexible cable 77 pass through the keyhole-shaped apertures 71** and the cable slides down the narrow slot portion of the keyhole-shaped apertures.

When it is desired to extend the wheelchair to its full, normal width, the quick attaching and detaching devices may easily be detached. It is necessary to remove only one end of the device 35 from one side frame 13 or 15 to allow the wheelchair to expand to its normal width. A principal feature of the invention is that the device is ever present on the wheelchair and is always ready for use. The free end of the device may be secured on the wheelchair in a convenient location thereon.

Those skilled in the art will recognize from the foregoing description of the embodiments of the invention shown in the drawing several features and advantages among which are:

That the wheelchair is quickly and easily held at the width when the attachment is applied in the manner described;

That the device of the invention is quickly and easily detached from one of the side frames to allow the wheelchair to expand to its normal width;

That the device is simple to construct and use; and

That the device is inexpensive and is reliable.

Although the invention has been described with a certain degree of particularity, it is understood that other modifications may be made thereto without departing from the scope of the invention as defined by the following claims.

What is claimed is:

1. In a wheelchair of the foldable type having vertical side frames with wheels journaled thereto, the improvement for maintaining said wheelchair at a reduced width comprising (a) a flexible elongate member disposed between said side frames, (b) means for adjusting the length of said elongate member, said means comprising, (i) a pair of turnbuckle-like members having an open ended threaded cavity therein and an aperture in a closed end portion thereof, (ii) a pair of eyebolt members threadedly received in said turnbuckle-like members, and (iii) a flexible cable extending through said apertures with stop members within each cavity fixed to the ends of said cable, (c) a length of flexible cable looped through the eye portion of each eyebolt and looped around said side frame;

(d) a bent plate having one aperture therein through which one end of said length of flexible cable passes, said one end carrying a stop member that is incapable of passing through said one aperture; and (e) a second aperture in said plate of such size and shape that a stop member fixed to the other end of said length of flexible cable is incapable of passing through another portion of said second aperture.

2. In a wheelchair of the foldable type having vertical side frames and main wheels journaled thereto, the improvement for maintaining said wheelchair at a reduced width, said improvement comprising a flexible cable disposed between said side frames and having means at least at one end removably attaching said cable to one of said side frames, said means comprising a plate member engaging one of said side frames, a first aperture in said plate member such that an end portion of said flexible cable is disposed surrounding said side frame, and a stop member fixed to the end of said flexible cable passed through a portion of a second aperture in said plate member and prevented from passing through another portion of said second aperture.

3. In a wheelchair of the foldable type having side frames with main wheels journaled to said side frames, and a fabric back and a fabric seat attached to said side frames, an improvement for maintaining said wheelchair at reduced width comprising: an elongate member disposed below said fabric seat between said side frames and having end portions attached to said side frames; means for adjusting the length of said elongate member including at least one turnbuckle-like element attached to said elongate member and having an internal thread at one end and an eyebolt having a threaded portion threadedly engaged in said turnbuckle-like element, means for releasably securing at least one end portion of said elongate member comprising a length of flexible cable looped through said eyebolt and around a side frame with one end of said length of flexible cable being secured to a plate member and the other end of said flexible cable being releasably connected to said plate member.

4. The improvement of claim 3 wherein said turnbuckle-like member has an internal cavity at one end, said internal cavity having an aperture therethrough, and said elongate member comprising a flexible cable passed through said aperture, and means within said cavity secured to the end of said flexible cable for preventing said flexible cable from being withdrawn from said cavity.

5. The improvement of claim 4 comprising a pair of said turnbuckle-like members interconnected by said flexible cable.

6. The improvement of claim 4 wherein said means within said cavity is a ball affixed to the end of said flexible cable.

7. The improvement of claim 5 wherein said means within said cavity is a ball affixed to each end of said flexible cable.

8. The improvement of claim 3 wherein said elongate member is a flexible cable and said means for releasably securing at least one of the end portions of said flexible cable comprises a plate member engaged with said side frame, a hole in said plate member through which said flexible cable is passed, an aperture in said plate member, and a retainer mounted on the end of said flexible cable, said aperture in said plate member being such as to provide a portion permitting passage therethrough of said retainer and a narrower portion preventing withdrawal of said retainer through said aperture.

* * * * *